US007950157B2

(12) United States Patent
Saunders et al.

(10) Patent No.: US 7,950,157 B2
(45) Date of Patent: May 31, 2011

(54) ROUTER PLANE

(75) Inventors: Terry R. Saunders, North Gower (CA); Ewan Smith, Ottawa (CA)

(73) Assignee: Lee Valley Tools, Ltd., Ottawa, Ontario (CA)

( * ) Notice: Subject to any disclaimer, the term of this patent is extended or adjusted under 35 U.S.C. 154(b) by 917 days.

(21) Appl. No.: 11/511,922

(22) Filed: Aug. 29, 2006

(65) Prior Publication Data

US 2008/0085164 A1 Apr. 10, 2008

(51) Int. Cl.
*B27F 1/00* (2006.01)

(52) U.S. Cl. ..... 30/486; 30/489; 269/254 CS; 269/53

(58) Field of Classification Search ..... 30/480, 30/481, 482, 486, 487, 488, 489, 490, 491, 30/492, 493, 280, 281; 144/136.95, 154.5, 144/48.5; 409/180, 181, 182; 83/698.11, 83/698.31, 881; 403/148, 326; 296/254 CS, 296/53, 70

See application file for complete search history.

(56) References Cited

U.S. PATENT DOCUMENTS

| | | | | | |
|---|---|---|---|---|---|
| 17,403 | A | | 5/1857 | Williams | |
| 36,973 | A | | 11/1862 | Traut | |
| 141,475 | A | | 8/1873 | Traut | |
| 152,488 | A | | 6/1874 | Hawley | |
| 174,879 | A | | 3/1876 | Vetterlein | |
| 176,151 | A | * | 4/1876 | Traut et al. | 30/281 |
| 272,801 | A | * | 2/1883 | Tupper et al. | 30/486 |
| 294,724 | A | * | 3/1884 | Cope et al. | 30/486 |
| 350,352 | A | * | 10/1886 | De Huff | 30/486 |
| 504,003 | A | | 8/1893 | Traut | |
| 609,681 | A | * | 8/1898 | Kniffen et al. | 30/486 |
| 685,411 | A | * | 10/1901 | Schade et al. | 30/486 |
| 793,297 | A | * | 6/1905 | Hesley et al. | 30/481 |
| 843,915 | A | * | 2/1907 | Stone | 30/121 |
| 865,560 | A | * | 9/1907 | Bartlett et al. | 30/490 |
| 902,977 | A | * | 11/1908 | Link et al. | 30/481 |
| 985,209 | A | * | 2/1911 | Russell | 76/79 |
| 1,012,591 | A | | 12/1911 | Bodmer et al. | |
| 1,026,053 | A | * | 5/1912 | Saner | 30/493 |
| 1,433,321 | A | * | 10/1922 | Wigtil | 30/486 |
| 1,663,935 | A | * | 3/1928 | Cornell | 30/281 |
| 2,550,766 | A | | 5/1951 | Bryant | |
| 2,694,260 | A | | 11/1954 | Johansson | |
| 2,811,886 | A | * | 11/1957 | Pedersen | 82/161 |
| 2,879,592 | A | * | 3/1959 | Paul | 30/272.1 |
| 3,833,195 | A | * | 9/1974 | Anton | 248/125.1 |

(Continued)

OTHER PUBLICATIONS

Southerland, Jay.Stanley No. 71 Router Type Study [online],Mar. 2003 [retrieved Mar. 16, 2009].Retrived from the Internet:<URL:http://www.hyperkitten.com/tools/routers/stanley/stanley_71.html>.*

(Continued)

*Primary Examiner* — Jason Daniel Prone
*Assistant Examiner* — Jennifer Swinney
(74) *Attorney, Agent, or Firm* — Kilpatrick Townsend & Stockton LLP; John S. Pratt; Camilla C. Williams

(57) ABSTRACT

A router plane having a collar maintained in snug engagement with a blade shank during blade height adjustment to facilitate accurate adjustment with a threaded adjustment nut that travels on an adjustment post. The collar is retained on a post secured to the router plane body so that the collar can rotate between blade in-board and blade out-board positions without removal from the post.

5 Claims, 6 Drawing Sheets

U.S. PATENT DOCUMENTS

| | | | | |
|---|---|---|---|---|
| 4,589,209 | A * | 5/1986 | Zarges et al. | 30/478 |
| 4,791,732 | A | 12/1988 | Bruno, Jr. et al. | |
| 4,930,221 | A | 6/1990 | Taylor | |
| D313,190 | S | 12/1990 | Economaki | |
| 5,050,306 | A | 9/1991 | Renaud | |
| 5,195,221 | A * | 3/1993 | Kanamaru et al. | 24/429 |
| 5,197,195 | A | 3/1993 | Aikens | |
| 5,381,602 | A * | 1/1995 | Matzo et al. | 30/377 |
| 5,561,903 | A * | 10/1996 | Bourbeau | 30/90.4 |
| 6,167,628 | B1 | 1/2001 | Jones et al. | |
| 6,408,527 | B1 | 6/2002 | Chubb | |
| 6,558,091 | B2 * | 5/2003 | Smith et al. | 409/204 |
| D517,931 | S | 3/2006 | Hyde | |
| 2003/0008754 | A1 * | 1/2003 | Fon | 482/57 |

OTHER PUBLICATIONS

Derek Cohen, "The Lee Valley Router Plane," Old Tools Shop, www.oldtoolsshop.com, Jan. 16, 2006.

"The Superior Works: Patrick's Blood and Gore Planes #71-#87," www.supertool.com/StanleyBG/stan10.html, 1998.

Derek Cohen, "The Lee Valley Router Plane," Old Tools Shop, www.OldToolsShop.com, Jan. 12, 2006.

Frampton, Alice, "Wheel Marking Gauges Review," Woodworking Magazine, WoodCentral (2005); http://www.woodcentral.com/cgi-bin/readarticle.pl?dir=reviews&file=articles_734.shtml, printed Nov. 29, 2006.

"Small Router Plane," Lie-Nielsen Toolwords Inc., http://www.lie-neilsen.com/catalog.php?sku=271, 1995.

* cited by examiner

ROUTER PLANE

FIELD OF THE INVENTION

This invention relates to manual or hand router planes.

BACKGROUND OF THE INVENTION

Router planes or routers are fitted with a relatively narrow cutter and are generally used to form or refine a recess in a work piece. Typically a body having a sole for contact with a work piece is held and manipulated by two handles or knobs attached to the body, and a cutter having a cutting arris on a foot projecting from a the cutter shank is secured to the body to project below the sole.

The blade or cutter in router planes has usually been a sharpened foot projecting at approximately a right angle from a shank or shaft that is secured in the plane body in a position orthogonal to the router sole. Such a blade is usually secured to an upstanding post portion of the plane body also orthogonal to the router sole, typically with a collar that encircles the blade shaft or shank and upstanding post, and a thumbscrew threaded into the collar bears against the post to tighten the collar. Early router planes held the blade or cutter in place solely by friction, and positioning was accomplished by loosening the collar and sliding the blade to a new position. Later improvements used a thumbnut traveling on a threaded rod fixed in the plane body to adjust the position of the cutter.

Notwithstanding such improvements, the depth of cut and position of blades have often been difficult to adjust accurately and repeatably in prior router planes. Alternatives for lateral positioning of the blade or cutter have also been limited.

Consequently, there remains a need for an improved router plane.

SUMMARY OF THE INVENTION

The router plane of this invention preferably utilizes a generally square cross-section blade shaft or shank that is mountable in either of two alternative locations in the body and in multiple rotational positions in the outboard or bullnose location. The blade shaft is secured to the body with an appropriately shaped collar that accommodates the multiple rotational positions and can be rotated relative to the body to permit the shaft to be secured in either of the two alternative positions. The spring-loaded blade-clamping collar holds the blade in position when the collar is loosened and provides tactile feedback for controlled blade depth adjustment. The collar can also be made to fully release by pressing the collar-tightening thumb screw forward after rotating it to loosen it for quick and easy blade removal or reorientation. The blade can be positioned in front of the post (inboard of the plane body) for general work, behind the post (outboard of the body) for bullnose applications or laterally (left or right) for work on hinge gains.

The collar is located on a body post that has a projecting rim. This rim and the pin structure associated with the collar together limit upward travel of the collar so that the collar cannot be removed without removing the body post from the body. The blade is secured to the body with the collar utilizing a locking knob having a shaft threaded into the collar and to which a spring loaded, telescoping locking pin is attached in such a manner that the locking collar will be held snugly in position even when the locking knob is not fully tightened. This reduces backlash during blade adjustment, facilitating precise blade positioning and adjustment. Protrusions located on the inside surface of the collar contact the blade shaft in a manner that insures that the blade accurately aligns itself with one of two V-grooves in the body post rather than by reference to the collar itself.

DETAILED DESCRIPTION

Figure 1:
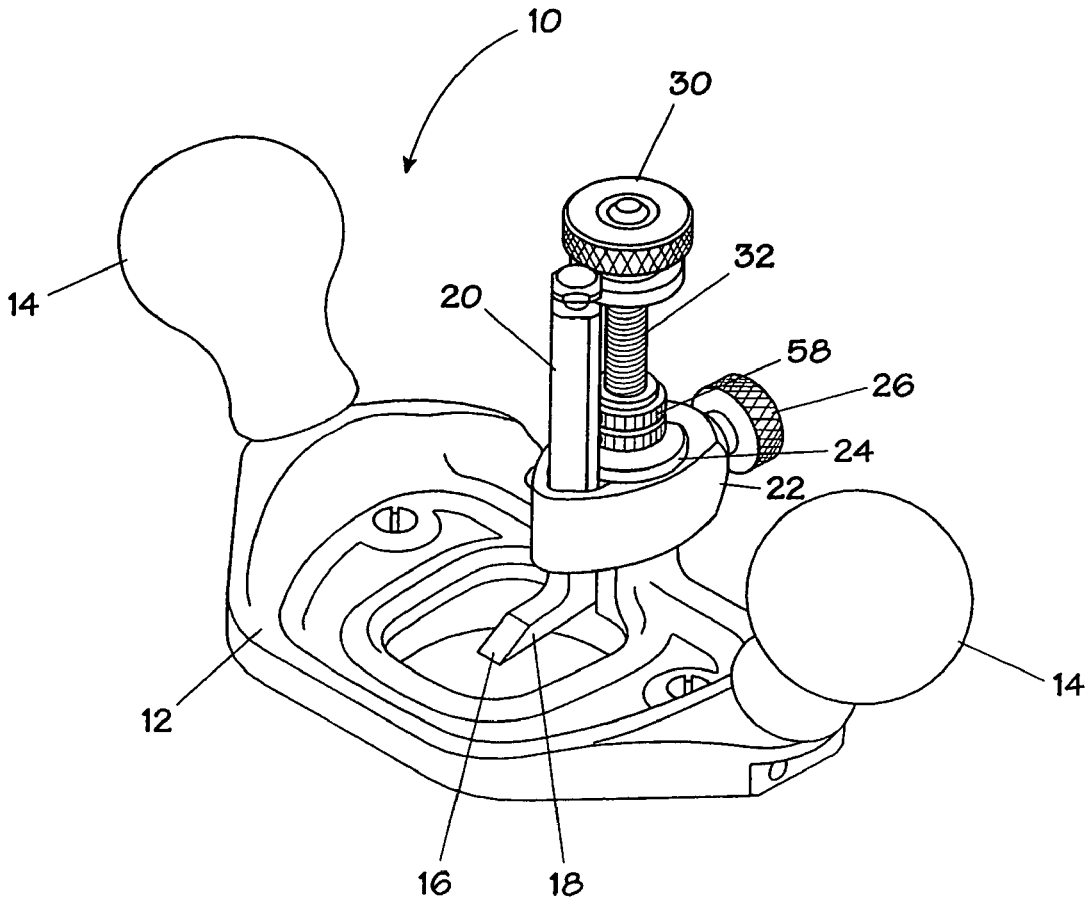
FIG. 1 is a perspective view of the front and right side of the router plane of this invention.

In the figures, a router plane 10 exemplary of this invention has a plane body 12 manipulated with knobs 14 to cause a blade 16 to engage a work piece (not shown) as desired. Blade 16 has a foot 18 attached to a shank or shaft 20. Shaft 20 is secured to plane body 12 with a collar 22 that encircles the shaft 20 and clamps it against a body post 24 by rotating a thumb screw 26. The projection of blade 16 beyond the sole 28 of body 12 can be adjusted in small increments by rotating blade adjustment knob or thumb nut assembly 30 which is threaded onto a threaded adjustment post 32.

Figure 2:
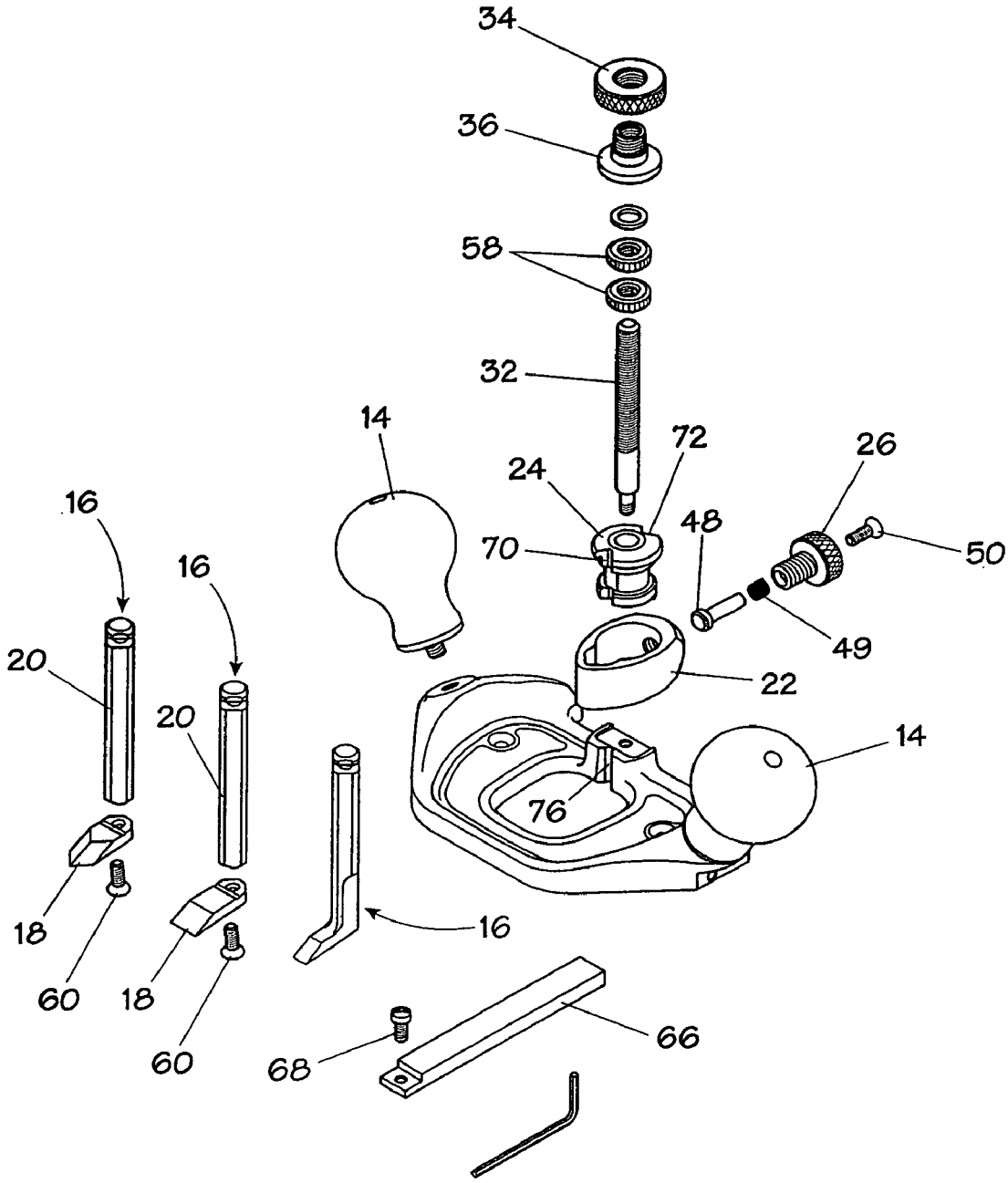
FIG. 2 is an exploded perspective view of the router plane shown in FIG. 1, together with alternative blades and a blade holder for blade sharpening.

Blade adjustment assembly 30 may be fabricated in one piece or it may be, as illustrated in FIG. 2, two pieces: a knurled knob 34 (which can be brass) and an internally threaded disk 36 (that can be steel) that has a washer-shaped flange 38 that engages a neck 40 near the top of shaft 20 to drive shaft 20, 20', or 20" up or down by rotating knurled knob 34.

Figure 3:
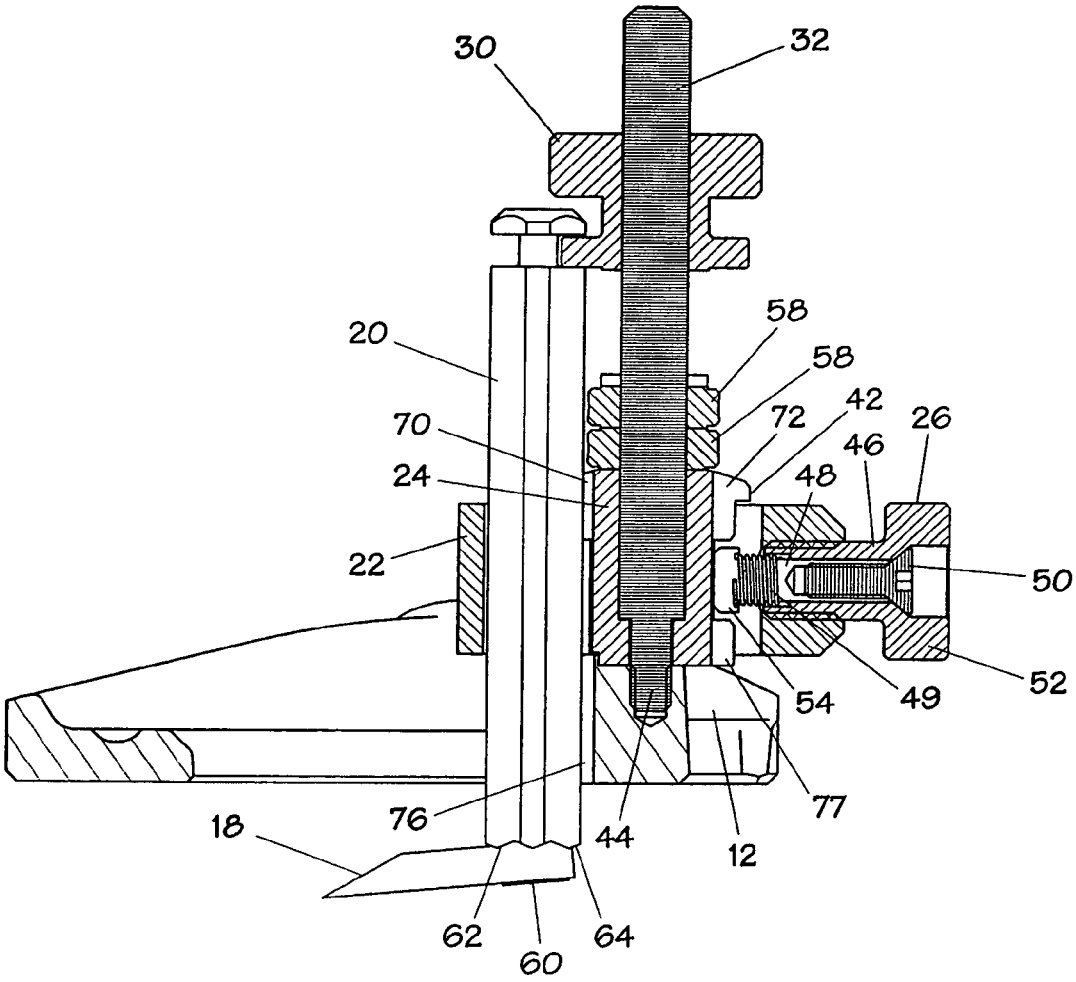
FIG. 3 is a right side view, in section, taken through the middle of the router plane of FIG. 1.

As can be appreciated by reference to FIGS. 2 and 3, collar 22 encircles body post 24 and is trapped on that post when post 24 is secured to the body 12 because its lip or rim 42 prevents collar 22 from moving upward on post 24. Body post 24 is secured to the body 12 with a threaded post 32 that passes through post 24 and, with a smaller diameter threaded portion 44, is screwed into body 12.

As may be appreciated by reference to FIG. 2, the narrow blade 16 shown in FIG. 1 can, when desired, be replaced by a wider blade 16' having a wider foot 18' on a corresponding shaft 20' or a spear point blade 16" having a spear point cutter 18" on a shaft 20".

Figure 4:
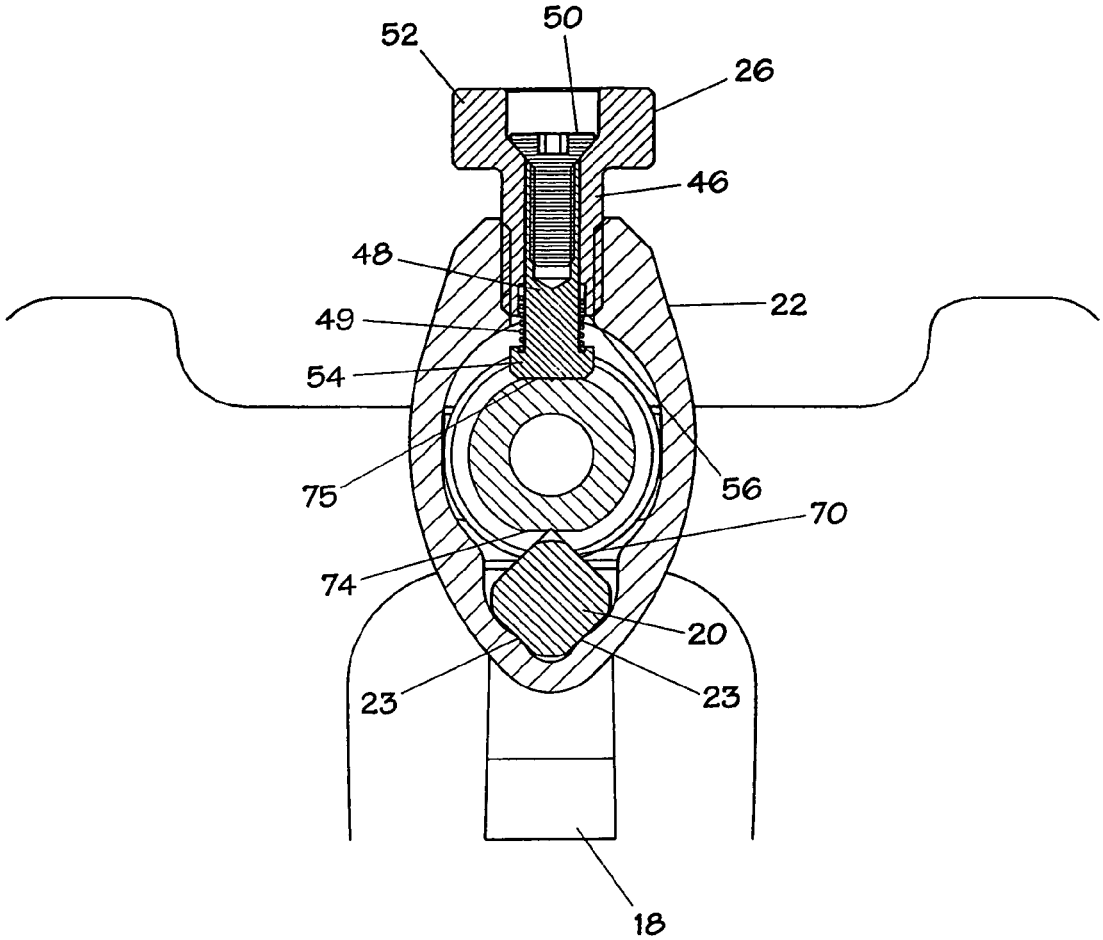
FIG. 4 is a partial top view of the router plane of FIG. 1, with the knobs omitted and in horizontal section through the middle of the locking collar, post and blade shaft.
Figure 5:
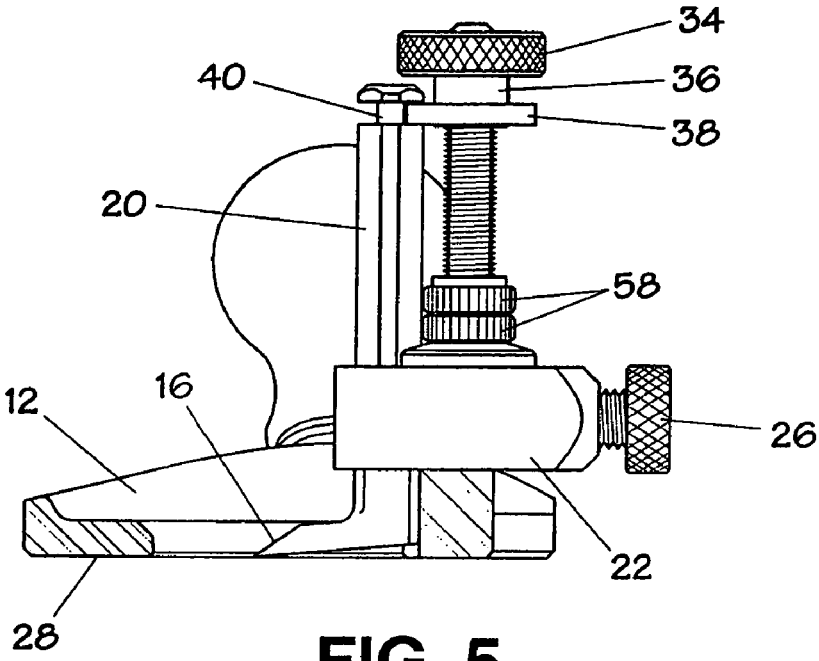
FIG. 5 is a side elevation view of the router plane of FIG. 1 with a portion of the plane body broken away to improve visibility of the blade depth adjusting and locking mechanisms.
Figure 6:
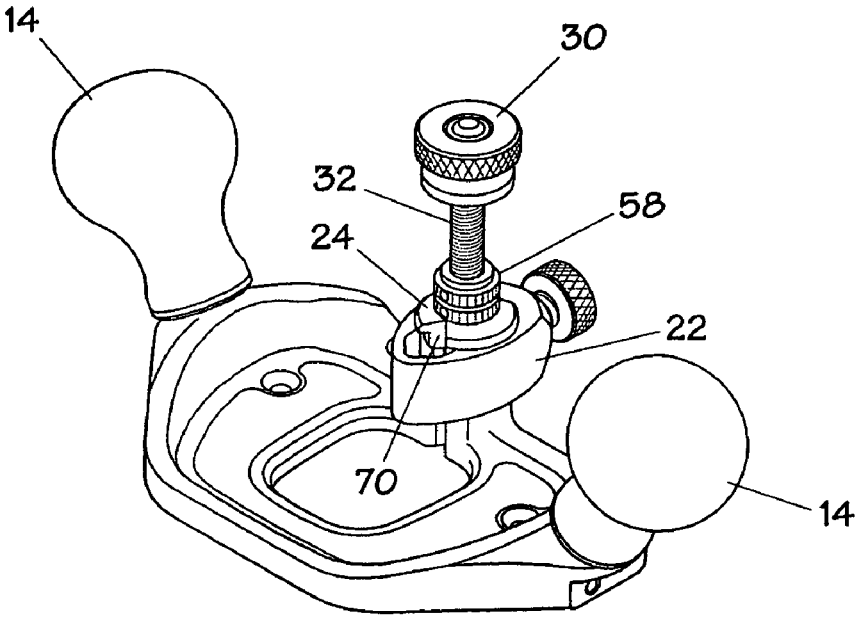
FIG. 6 is a perspective view similar to FIG. 1 but with the blade removed.
Figure 7:
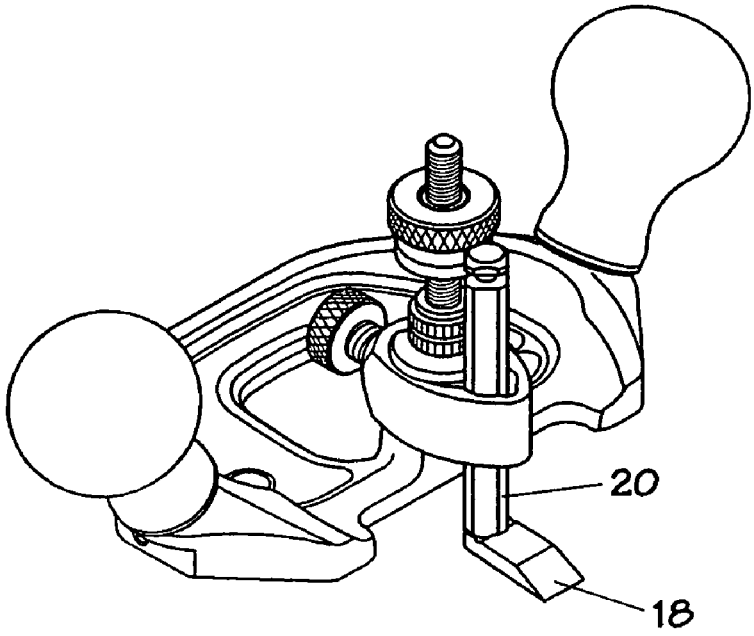
FIG. 7 is a perspective view of the left side and front of the router plane of FIG. 1 with the locking collar and blade rotated to the outboard blade position.
Figure 8:
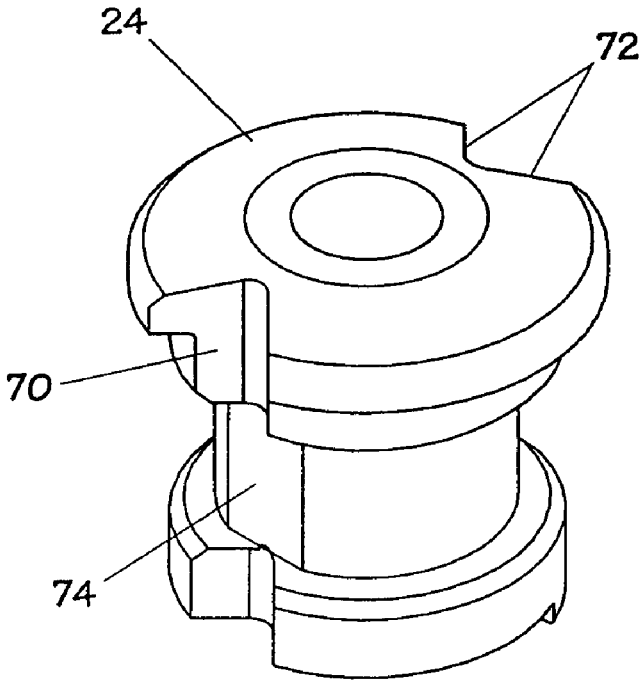
FIG. 8 is an enlarged perspective view of the top and inboard side of the body post of the plane shown in FIG. 1.

Collar 22 is tightened against shank 20, 20', 20" by rotating thumb screw or locking knob 26 to press locking pin 48 against body post 24, thereby drawing shank 20, 20', 20" tightly against body post 24. As may be appreciated by reference to FIGS. 3 and 4, locking pin 48 telescopes into the shank 46 of thumb screw 26 and is spring loaded by spring 49 so that pin 48 continues to exert some force on body post 24 even when thumb screw 26 has been loosened by a small amount. This keeps collar 22 relatively snugly in contact with shank 20, 20', 20" during adjustment of the position of blade 16, greatly facilitating easy adjustment by preventing blade 16 from falling out of position as soon as thumb screw 26 is loosened. Pin 48 is retained in thumb screw 26 by a machine screw 50 inserted through the head 52 of thumb screw 26 and into the head 54 of pin 48. When knob 26 is rotated to tighten collar 22, pin 48 slides into shank 46 until the head 54 of pin 48 contacts the end 56 of shank 46, thereby firmly fixing collar 22 and blade 16 in position on body post 24. (As is best seen in FIG. 4, pin 48 always contacts body post 24 at a flat surface—either surface 74 when the blade 16 is positioned inboard as it is in FIGS. 1, 2, 3 and 5, or surface 75 when blade 16 is positioned outboard as illustrated in FIG. 7. This flat surface to flat surface contact facilitates secure locking of collar 22 and effective function of the spring-loaded pin 48 feature.) With collar 22 slightly loosened, the height of blade 16 may be adjusted by rotating thumb nut assembly 30. Downward travel of thumb nut assembly 30 (and therefore depth of cut of blade 16) may be limited at a predetermined position by locking stop nuts 58 in a position on threaded post 32 that stops travel of thumb nut 30 with blade 16 at a desired position. Stop nuts 58 can be locked in a position by tightening them against each other. Alternatively, a set screw (not shown) threaded into one of the stop nuts 58 can be used to lock that stop nut to the post 32.

The blade 16 may be formed in one piece having a shank 20 and a foot 18 or with separate shank 20' or 20" and a removable foot 18' or 18" secured to the shank with a screw 60. A series of grooves 62 in foot 18' or 18" inter-fits with a corresponding series of grooves 64 on shank 20' or 20" (illustrated in FIG. 3) to facilitate correct positioning and retention of the foot on the shank when the two are attached with a screw 60.

Detachable feet 18' or 18" can be more easily sharpened by attaching them to a sharpening blade holder 66 with a screw 68 (both illustrated in FIG. 2).

Although shanks 20, 20' and 20" could be round or have other cross-sectional shapes, if they are generally square they can seat very firmly and be effectively retained by protrusions 23 on the inside of collar 22 without rotating in one of the two V-shaped grooves 70 and 72 in body post 24 as can be seen in FIG. 4. Compare, for instance FIGS. 1 and 7 to see positioning in the two V-shaped grooves 70 (FIG. 1) and 72 (FIG. 7). Moreover, the generally square cross sectional shape enables shanks 20, 20' and 20" to be positioned in the bullnose or outboard position shown in FIG. 7 in alternative rotational positions rotated by 90 degrees from each other. As is illustrated in FIGS. 1, 2, 3 and 8, the V-shaped groove 70 in body post 24 is aligned with a V-shaped groove 76 in body 12. This lower V-shaped groove 76 provides support for shank 20, 20', 20" low on the shank and near foot 18, 18', 18" when the blade 16 is positioned inboard as illustrated in FIGS. 1, 2, 3 and 5 to reduce shank flexing and blade chatter. It is not possible to provide identical support against body 12 when blade 16 is positioned outboard as illustrated in FIG. 7 because such support would prevent rotating blade 16 to a left or right lateral position when it is outboard. However, body post 24 carries a lower V-shaped groove 77 on the outboard side of post 24 to provide additional shank support in the outboard position.

As will be appreciated by those skilled in the art numerous modifications and variations of the router plane 10 described above and illustrated in the figures can be made without departing from the scope and spirit of this invention or the following claims. For instance, a variety of materials could be used for the plane components, including, but not limited to, ductile iron for the plane body 12, ductile iron or stainless steel for body post 24, wood, metal or plastic for the knobs 14, steel or brass for the threaded components and a variety of other appropriate materials. Additionally, alternative structures could be used in order to exert sufficient pressure to hold the collar 22 and blade 16 in position during the adjustment process even when the collar locking mechanism is disengaged. For instance, other spring and pin arrangements could be used, or a spring arrangement holding the components in position could be made separate from the position locking mechanism provided by thumbscrew 26 in the embodiment described in detail above. These and other such modification are within the scope of the present invention.

The invention claimed is:

1. A router plane, comprising:

a. a plane body having a sole, b. a blade post attached to the body generally perpendicular to the sole, c. a blade having a shank, d. a collar for securing the blade to the post, e. a threaded member for adjusting the projection of the blade relative to the sole by rotating the member, and f. a spring-loaded mechanism for maintaining engagement between the collar and the blade shank while permitting adjustment of blade projection and for securing the blade within the plane after adjustment of blade projection, the mechanism comprising:

(i) a thumb screw penetrated by a longitudinal bore, (ii) a coiled compression spring, and (iii) a pin having a flat head attached to a shank, wherein:

(i) the shank of the pin is surrounded by the coiled spring, and (ii) the shank of the pin is slidably positioned within the bore in the thumb screw, and (iii) the shank of the pin is urged by the coiled spring to project from the thumb screw forcing the flat head of the pin against the post when the thumb screw is not fully tightened, thereby maintaining engagement between the collar and the blade shank to permit adjustment of blade projection, and (iv) the head of the pin is more securely forced against the post by the thumb screw when the thumb screw is fully tightened, thereby securing the blade to the post for router plane use.

2. The router plane of claim 1, wherein the collar can be rotated on the post between a blade-inboard position with the blade projecting through a hole in the sole and a blade-outboard position with the blade projecting away from the sole without removing the collar from the post.

3. The router plane of claim 2, wherein two projections from an inside surface of the collar contact faces of the blade shank to secure the blade to the post.

4. The router plane of claim 3, wherein the blade shank is received in one of two V-shaped grooves in the post.

5. The router plane of claim 1, further comprising a threaded post on which the threaded member is positioned and a pair of locking nuts positionable on the threaded post below the threaded member to provide a depth stop to prevent positioning the blade below a predetermined depth.

* * * * *